US007841101B1

(12) United States Patent
Thompson

(10) Patent No.: US 7,841,101 B1
(45) Date of Patent: Nov. 30, 2010

(54) ROOFING INSTALLATION APPARATUS

(76) Inventor: Glen A. Thompson, 930 S. Strong Rd., Strong, ME (US) 04983

( * ) Notice: Subject to any disclaimer, the term of this patent is extended or adjusted under 35 U.S.C. 154(b) by 215 days.

(21) Appl. No.: 12/238,732

(22) Filed: Sep. 26, 2008

(51) Int. Cl.
*G01D 21/00* (2006.01)
*E04D 15/02* (2006.01)

(52) U.S. Cl. ..... 33/649; 33/648; 52/749.12

(58) Field of Classification Search ..... 33/646–649; 52/748.1, 749.12, DIG. 1, 749.1; 81/45
See application file for complete search history.

(56) References Cited

U.S. PATENT DOCUMENTS

| | | | | |
|---|---|---|---|---|
| 54,584 | A | 5/1866 | Newbank | |
| 205,795 | A | 7/1878 | Green | |
| 338,156 | A | 3/1886 | Johnson | |
| 443,467 | A | 12/1890 | Templin | |
| 563,830 | A | 7/1896 | Pelley | |
| 631,315 | A * | 8/1899 | Meskill | 33/647 |
| 710,281 | A | 9/1902 | Leek | |
| 780,697 | A | 1/1905 | Adams | |
| 786,710 | A | 4/1905 | Anderson | |
| 844,612 | A | 2/1907 | Morris | |
| 852,141 | A | 4/1907 | Sebree | |
| 988,808 | A | 4/1911 | Parris | |
| 1,067,121 | A | 7/1913 | Johnson | |
| 1,210,469 | A | 1/1917 | Harshberger | |
| 1,366,462 | A | 1/1921 | Johnson | |
| 1,396,274 | A | 11/1921 | Neumeister | |
| 1,405,760 | A | 2/1922 | Collins et al. | |
| 1,586,946 | A | 6/1926 | Carr | |
| 2,157,663 | A | 5/1939 | Giebink | |
| 2,214,999 | A | 9/1940 | Hullinger | |
| 2,470,183 | A | 5/1949 | Peters | |
| 2,486,748 | A | 11/1949 | Koenig | |
| 2,762,130 | A | 9/1956 | Olson | |
| 2,887,781 | A | 5/1959 | Mills | |
| 2,889,632 | A | 6/1959 | Longhi | |
| 2,891,318 | A | 6/1959 | Harrison et al. | |
| 3,110,113 | A | 11/1963 | Baker | |
| 3,490,152 | A | 1/1970 | Printz | |
| D246,441 | S | 11/1977 | Bergendorff | |
| 4,056,889 | A | 11/1977 | Barnett, III | |
| 4,110,911 | A | 9/1978 | Sucheck | |
| 4,183,144 | A | 1/1980 | Barnett, III | |
| D263,443 | S | 3/1982 | Reniker et al. | |
| D272,711 | S | 2/1984 | Griset | |
| 4,473,100 | A * | 9/1984 | Wheeler | 81/45 |
| 5,018,279 | A | 5/1991 | Williams | |
| 5,107,600 | A | 4/1992 | Riesberg | |
| 5,311,670 | A | 5/1994 | Tomoiaga | |

(Continued)

*Primary Examiner*—Amy Cohen Johnson
(74) *Attorney, Agent, or Firm*—Dennis R. Haszko

(57) ABSTRACT

A roofing installation device for enabling quick and accurate installation of shingle type roofing. The device includes a generally c-shaped inner portion and correspondingly c-shaped outer portion slidable relative to one another. The inner and outer portions include at least one spring there between in an expansion state such that manual compression allows a user to clamp the device onto a first shingle layer. An adjustable portion is affixed to the inner portion and includes a stop edge to allow placement of a second shingle layer in such a manner to form a predetermined surface exposure of the first shingle layer. The predetermined surface exposure is variable by moving the adjustable portion relative to the inner portion. Such adjustment is accomplished in a quick, manual manner.

19 Claims, 3 Drawing Sheets

U.S. PATENT DOCUMENTS 5,918,439 A 7/1999 Metzer et al.
7,134,253 B2 * 11/2006 Edwards et al. ..... 52/749.11
7,490,447 B2 * 2/2009 Ouellette et al. ..... 52/749.1

* cited by examiner

ROOFING INSTALLATION APPARATUS

FIELD OF THE INVENTION

The present invention relates generally to roofing installations. More particularly, the present invention relates to a device for enabling a roofing installer to install sectional roofing sheets in an overlapping manner with uniform surface exposure.

BACKGROUND OF THE INVENTION

In the residential construction industry, roofing typically consists of layered water-shedding surface in the form of shingles. A shingle may be made from a variety of materials including, but not limited to, asphalt which is the dominant roofing material used in residential construction today. The asphalt roofing industry has existed since the late 1800's with improvements continuing to the present day. However, improvements in the asphalt roofing itself do not always translate into improvements in the installation of such asphalt roofing. Overall, such installation has remained unchanged for many decades or more. Often, those individuals in the roofing trade rely on verbal or visual information, rather than formal education or regular updates about changes in their profession. Thus, a roofing apprentice may be taught by an individual who has been doing something wrong or against manufacturer's recommendations for years such that mistakes are ignored or overlooked.

A byproduct of installing asphalt roofing shingles in a manner contrary to written, established roofing practices as outlined by manufacturers and roofing associations is that such asphalt roofs are susceptible to leaks or premature failure. The performance of asphalt roofing shingles is dependent upon several factors including, but not limited to, roof slope, ventilation, roof substrate, flashing and drip edges, along with the quality, placement, quantity, and installation of fasteners. Installation of fasteners is often done pneumatically and must be placed correctly. The location of the fasteners and relative placement of shingle to one another are basic to successful roofing installation. As each successive course of shingle is applied, it is offset from the course below. This offset is needed to adequately cover the butt joint of the course below. This butt joint is where water may leak into the living space below. Fastener locations are designed so that they receive the maximum protection from the course of shingles immediately above them.

Today's standard three tab shingle is common to many homeowners, however dimensional type (e.g., "raised tab") asphalt shingles are becoming ever more popular. Some such shingles are designed to expose five inches of the shingle to the weather. In such shingle applications, manufacturers typically require fasteners be placed in specific locations along a line 5⅝ inches from the bottom (exposed) edge of the shingle. For high wind applications, even more fasteners are required. The difficulty to a roofing installer often becomes quickly and accurately fastening a loose shingle in the proper position atop a previous course of shingles with the appropriate amount of shingle exposure. Adding the vagaries of the work environment such as wind and rain compounds the difficulties experienced by a roofing installer.

It is, therefore, desirable to provide a mechanism for improved installation of roofing shingles.

SUMMARY OF THE INVENTION

It is an object of the present invention to obviate or mitigate at least one disadvantage of previous roofing installation mechanisms.

In one aspect, the present invention provides a device for use in roofing installation, the device including: an inner portion having a first surface for engaging a first roofing shingle and a second surface for engaging a second roofing shingle; an outer portion movable relative to the inner portion and having a tab for engaging an end of the first roofing shingle; an adjustable portion affixed to the inner portion and having a stop edge for engaging an end of the second roofing shingle; and wherein the end of the first roofing shingle and the end of said second roofing shingle are separated by a distance corresponding to a predetermined surface exposure of said first roofing shingle.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached figures.

DETAILED DESCRIPTION

Generally, the present invention provides an apparatus that enables a roofing installer to quickly and accurately install shingle-type roofing. The present invention allows a roofing installer to compensate for inconsistent spacing and nailing marks on shingles which may vary among manufacturers and among batches of shingles from the same manufacturer. The present invention also allows a roofing installer to accurately reduce shingle exposure necessary towards the ridge of a roof and thereby avoid unsightly final shingle spacing. As well, the present invention allows a roofing installer to significantly reduce reliance on chalk lines which are difficult to work with and impractical for use in wet weather. Although the present invention will be discussed in terms of shingles fabricated from asphalt, it should be understood that overlapping shingle-type roofing of any relatively thin sheet material (e.g., steel shingles) may benefit from the present invention.

Figure 1:
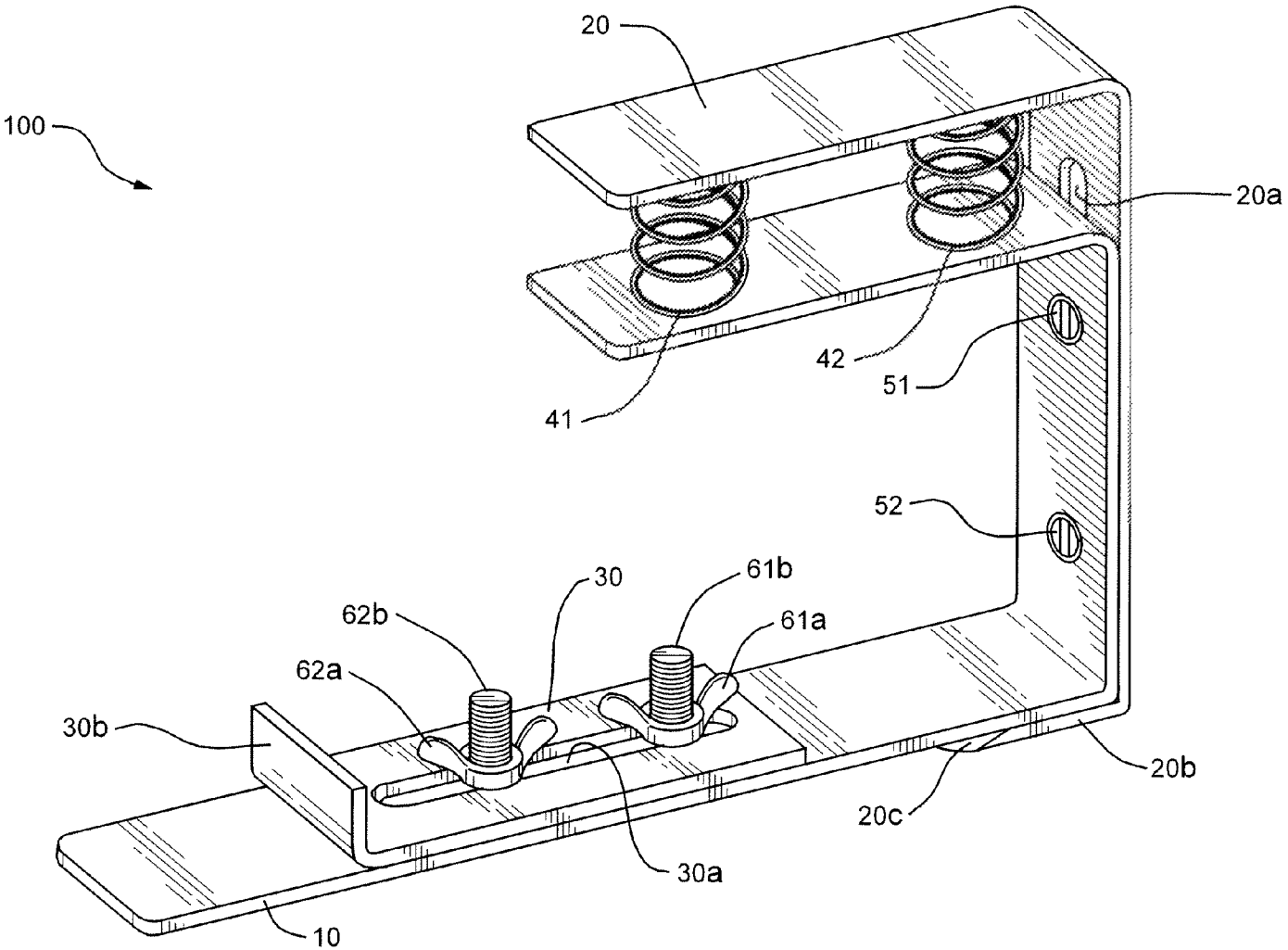
FIG. 1 is a perspective view of a roofing installation device in accordance with the present invention.

With reference to FIG. 1, an embodiment of the present invention is shown in terms of a roofing installation device 100. The device 100 includes three main parts: an inner portion 10, an outer portion 20, and an adjustable portion 30. The inner and outer portions 10, 20 are shown as generally C-shaped brackets. However, it should be understood that the specific shape and configuration may vary without straying from the intended scope of the present invention. Indeed, a variety of shapes may be utilized as well as a variety of materials. Preferably, all elements shown are fabricated from a durable material such as, but not limited to, steel alloy.

The inner and outer portions 10, 20 are connected in a manner such that they are movable relative to one another. The manner of connection shown includes bolts 51, 52 which are tightened only enough so that travel through channel 20*a* is allowed when springs 41 and 42 are compressed. When compression of springs 41 and 42 ceases, it should be readily apparent that inner portion 10 is press-fit against tab 20*b* of the outer portion 20. Such compression of springs 41 and 42 can be done manually by a user squeezing together the sections of inner portion 10 and outer portion 20 that surround the springs 41 and 42. Although coil springs are shown, it should be understood that any similar mechanism may be used to maintain the inner portion 10 in the normal resting position against tab 20*b*.

Still further, the adjustable portion 30 is shown affixed to inner portion 10 by way of wing nuts 61*a*, 62*a* and corresponding bolts 61*b*, 62*b* which can be loosened to allow sliding movement of adjustable portion 30 relative to inner portion 10 via channel 30*a*. It should be understood that once positioned, the adjustable portion 30 is held stationary relative to the inner portion 10 by ensuring that the wing nuts 61*a*, 62*a* are fully tightened. Positioning of the adjustable portion 30 can therefore be varied by the user of the roofing installation device 100. Varying such position accommodates differing shingle exposures as will be described further hereinbelow with further regard to FIGS. 2A and 2B Within each of the FIGS. 1, 2A, and 2B, it can be further seen that the tab 20*b* of outer portion 20 includes a chamfered edge 20*c*. The bevel that is formed on edge 20*c* allows the user to easily slide the tab 20*b* under a sheet of roofing when springs 41, 42 are manually compressed. Such configuration is shown in FIG. 2B where a bottom layer shingle 201 can be seen sandwiched between inner portion 10 and the tab 20*b* of outer portion 20. In operation, this would be the first step whereby the bottom layer 201 of shingle would be laid upon by a top layer shingle 200. The top layer shingle 200 would be abutted against the stop edge 30*b* formed on the adjustable portion 30.

With further regard to FIG. 2B, the adjustability of shingle exposure will be evident to one of ordinary skill in the art of roofing. Here, the distance between the end of shingle 200 abutting stop edge 30*b* and the end of shingle 201 at the tab 20*b* equates to the amount of top surface exposure of the bottom shingle 201. Accordingly, from FIG. 2B it is readily apparent that a user may adjust the minimum top surface exposure of the bottom shingle 201 by loosening wing nuts 61*a* and 62*a* and sliding the adjustment portion 30 towards tab 20*b*.

Figure 2A:
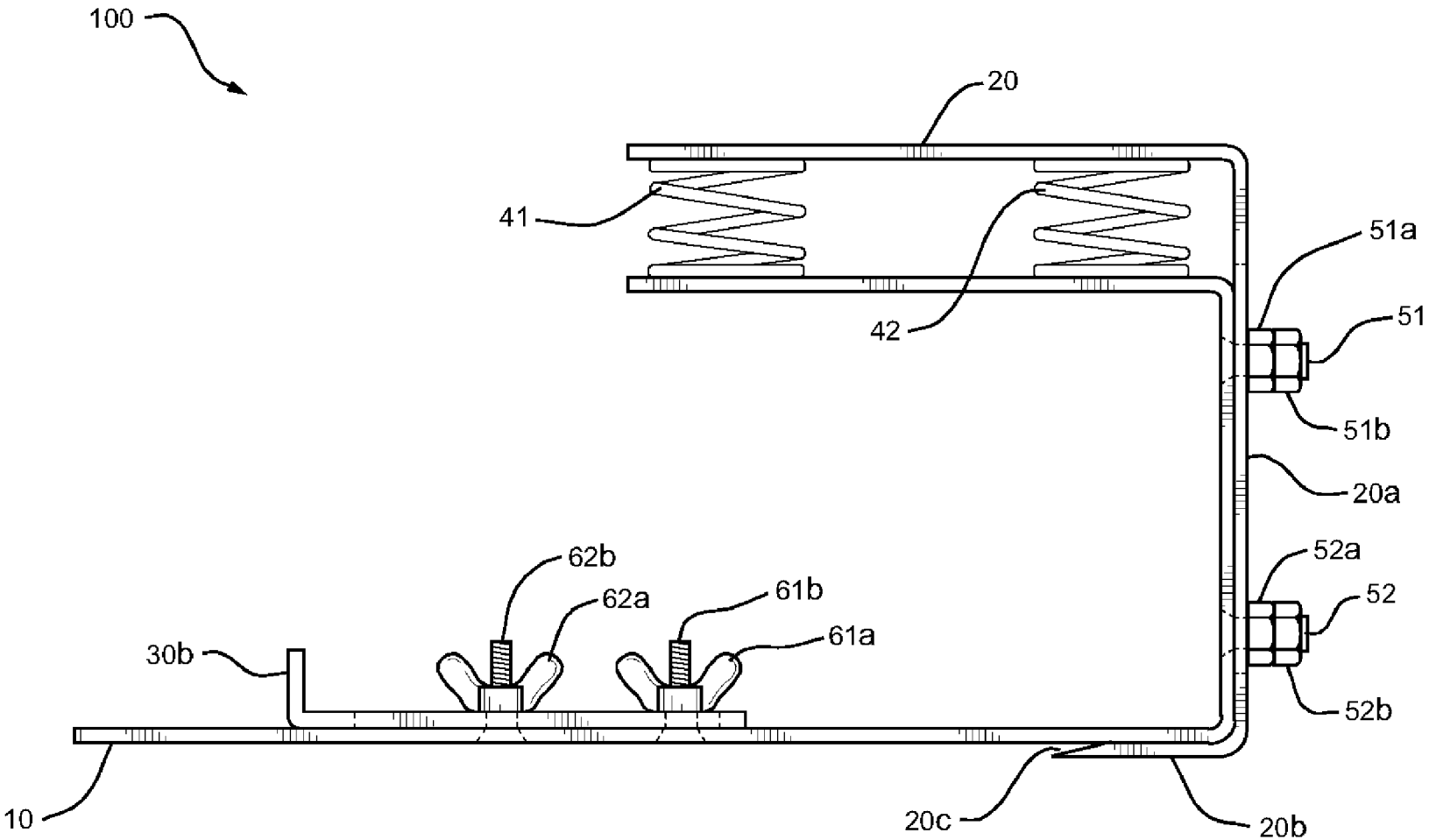
FIG. 2A is a side view of the invention as shown in FIG. 1.
Figure 2B:
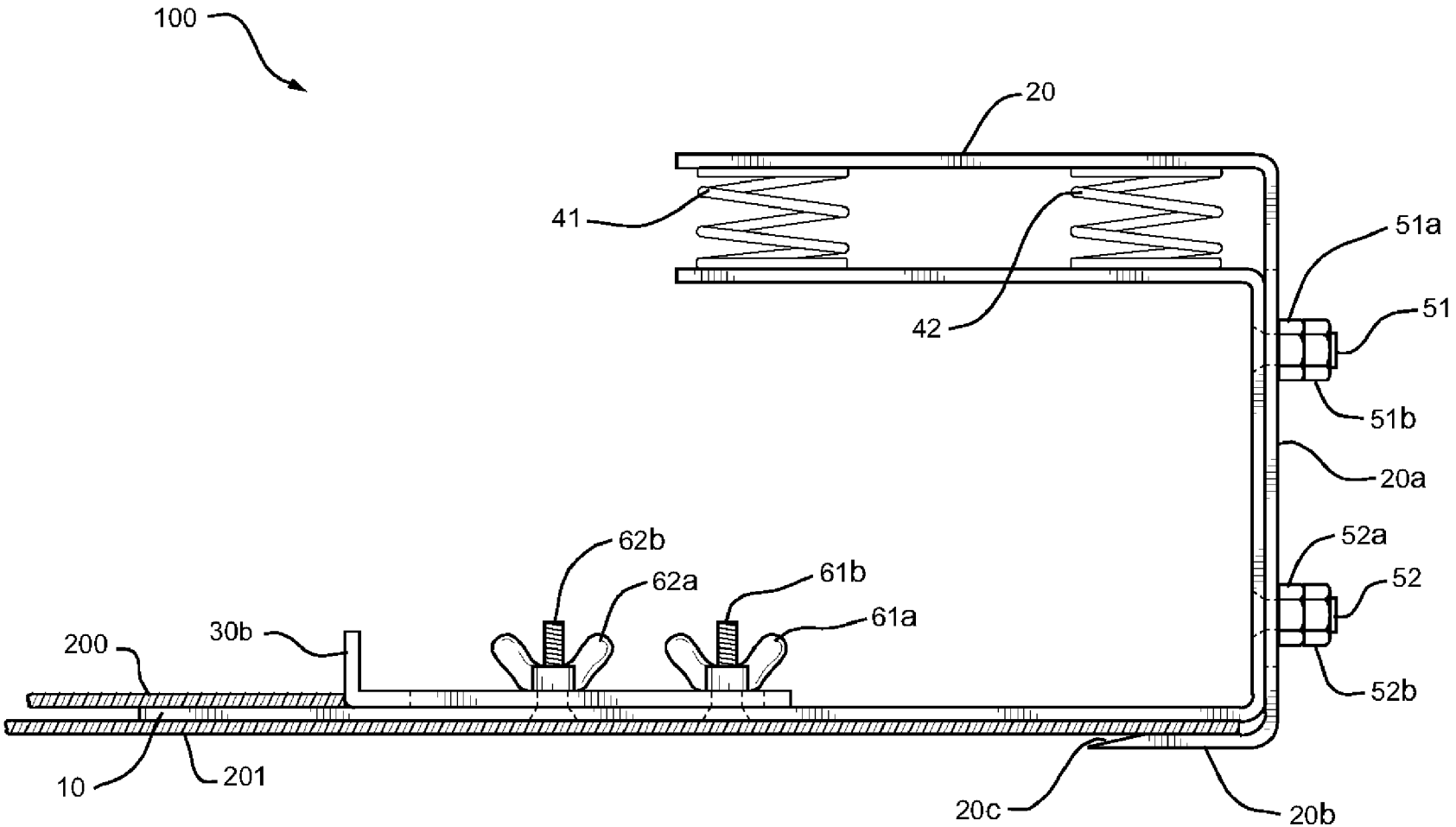
FIG. 2B is a side view of the invention as shown in FIG. 1, but shown in compression mode with cross-sections of overlapping shingles engaged with the invention.

In FIGS. 2A and 2B, bolts 51 and 52 are shown by dotted lines and are fixedly held within holes within the inner portion 10, but loosely held within the channel 20*a* within the outer portion 20. Lock nuts 51*a*, 51*b* and 52*a*, 52*b* secure the bolts 51 and 52 respectively in this manner. While a set of nuts (i.e., double-nuts) are shown for each bolt, it should be understood that any comparable locking nut such as, but not limited to, a nylon locking nut may be used to secure axial bolt movement, yet allow lateral sliding movement within channel 20*a* when springs 41 and 42 are compressed.

In operation, a user manually clamps the device 100 onto a previously laid row of shingles. Such clamping can be seen in FIG. 2B at tab 20*b*. The surface exposure distance can be set either before or after clamping of the previously laid row of shingles. Moreover, the surface exposure distance may be incrementally varied while laying each subsequent layer of shingles. For example, when approaching the ridge of a roof the surface exposure distance may be reduced incrementally to avoid any unsightly transitions from a standard exposure to a much smaller exposure at the final course of shingle. Although not shown in the figures, it should be further apparent to one of ordinary skill in the art that the inner portion 10 may include measurement lines or notches to indicate incremental movements of the adjustment portion 30. The inner portion 10 may also include further holes (not shown) to accommodate extreme movement of the adjustment portion 30 for very small surface exposures. In such instance, one or both bolts 61*b*, 62*b* would be moved to holes (not shown) closer to the tab 20*b* to allow the adjustment portion 30 to relocate towards the tab 20*b*.

After the first two courses of shingle are laid to a drip edge and/or chalk line as is common in the roofing art, the following courses of shingle are advantageously installed using the device 100. With further regard to operation of the device 100, clamping force is applied by squeezing the device 100 with one hand, then engaging the edge 20*c* and tab 20*b* under the bottom edge of the bottom shingle. Depending upon factors such as whether the user is right-handed or left-handed and whether the user is laying shingle left to right or right to left, the device may be placed on either the left side or the right side of the shingle. Thereafter, the user lets go of the device 100 so as to allow the springs 41, 42 to provide the holding force to maintain the device 100 in place atop the bottom shingle. The user then has both hands free to move the top shingle into place with the surface exposure set as discussed above such that the top shingle rests against stop 30*b*. As clearly shown in FIG. 2B, the stop 30*b* is elongated perpendicular to the surface of the area of inner portion 10 upon which the shingle 200 rests. This effectively provides an L-shaped cross-section as shown in regard to the stop 30*b*. As shown, the length of the stop 30*b* is several times the width of shingle 200. Working, for example, from left to right, the device will be set in place at the left side to start a new course of shingles. The user will initially fasten the shingle on the left, disengage the device 100, re-engage the device 100 on the right side, and add all remaining fasteners to secure the shingle as per manufacturers recommended fastener spacing. This is repeated until a complete course of shingle is made and then a new course may be completed. In this manner, the surface exposure can be quickly and accurately meted on each course and successive courses can include incrementally reduced surface exposure in an aesthetically pleasing manner.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A device for use in roofing installation, said device comprising:

an inner portion having a first surface for engaging a first roofing shingle and a second surface for engaging a second roofing shingle;

an outer portion movable relative to said inner portion and having a tab for engaging an end of said first roofing shingle;

said inner and outer portions being configured to compressingly retain said first roofing shingle within a gap formed between said first surface of said inner portion and said tab of said outer portion;

an adjustable portion affixed to said inner portion upon said second surface and having a stop edge for engaging without force an end of said second roofing shingle laid upon said second surface; and wherein said end of said first roofing shingle and said end of said second roofing shingle are separated by a distance corresponding to a predetermined surface exposure of said first roofing shingle.

2. The device as claimed in claim 1 wherein said adjustable portion is affixed to said inner portion via removable fasteners.

3. The device as claimed in claim 2 wherein said adjustable portion is movable so as to vary said predetermined surface exposure.

4. The device as claimed in claim 2 wherein each said removable faster is formed by a bolt and wingnut.

5. The device as claimed in claim 1 wherein said inner portion and said outer portion are connected in a sliding manner.

6. The device as claimed in claim 5 wherein said inner portion include holes and said outer portion includes a channel and bolts are fixedly attached to said inner portion through said holes and movably attached to said outer portion via said channel, said bolts being held in place via corresponding locking nuts.

7. The device as claimed in claim 1 wherein said first surface of said inner portion and said tab of said outer portion are normally pressed together by way of one or more springs held in expansion between said inner portion and said outer portion.

8. The device as claimed in claim 7 wherein said gap is formed when said one or more springs are compressed.

9. The device as claimed in claim 8 wherein said tab of said outer portion includes a chamfered edge to enable maneuvering said end of said first roofing shingle into said gap.

10. The device as claimed in claim 9 wherein said device is configured to retain said end of said first roofing shingle within said gap by force of said one or more springs.

11. The device as claimed in claim 10 wherein said one or more springs are coil springs.

12. The device as claimed in claim 1 wherein both said inner portion and said outer portion are generally c-shaped and nestingly fitted within one another.

13. A device for use in roofing installation, said device comprising:

an inner portion having a first surface for engaging a first roofing shingle and a second surface for engaging a second roofing shingle;

an outer portion movable relative to said inner portion and having a tab for engaging an end of said first roofing shingle;

an adjustable portion affixed to said inner portion and having an L-shaped stop edge extending perpendicular from an area adjacent said second surface of said inner portion, said L-shaped stop edge for engaging an end of said second roofing shingle and precluding movement of said second roofing shingle towards said end of said first roofing shingle; and wherein said end of said first roofing shingle and said end of said second roofing shingle are separated by a distance corresponding to a predetermined surface exposure of said first roofing shingle.

14. The device as claimed in claim 13 wherein said adjustable portion is affixed to said inner portion via removable fasteners.

15. The device as claimed in claim 13 wherein said adjustable portion is movable so as to vary said predetermined surface exposure.

16. The device as claimed in claim 13 wherein said inner portion include holes and said outer portion includes a channel and bolts are fixedly attached to said inner portion through said holes and movably attached to said outer portion via said channel, said bolts being held in place via corresponding locking nuts.

17. The device as claimed in claim 13 wherein said first surface of said inner portion and said tab of said outer portion are normally pressed together by way of one or more springs held in expansion between said inner portion and said outer portion.

18. The device as claimed in claim 13 wherein both said inner portion and said outer portion are generally c-shaped and nestingly fitted within one another.

19. The device as claimed in claim 13 wherein said tab of said outer portion includes a chamfered edge to enable maneuvering said end of said first roofing shingle into said gap.

* * * * *